US006047620A

United States Patent [19]

Kozak et al.

[11] Patent Number: 6,047,620

[45] Date of Patent: Apr. 11, 2000

[54] TOOL FOR INSERTING AND REMOVING ONE-WAY FASTENERS, AN OFF-CENTER TOOL FOR INSERTING AND REMOVING ONE-WAY FASTENERS

[76] Inventors: Burton Kozak, 1300 N. Lake Shore Dr., #28C, Chicago, Ill. 60610; Ira M. Kozak, 2475 Woodlawn Dr., Northbrook, Ill. 60062

[21] Appl. No.: 09/007,025

[22] Filed: Jan. 14, 1998

[51] Int. Cl.[7] ..... B25B 23/08

[52] U.S. Cl. ..... 81/441; 81/53.2; 81/451; 81/438

[58] Field of Search ..... 81/441, 437, 438, 81/451, 53.2

[56] References Cited

U.S. PATENT DOCUMENTS

| | | | |
|---|---|---|---|
| 3,135,306 | 6/1964 | Mangerian | 81/451 |
| 3,392,767 | 7/1968 | Stillwagon | 81/451 |
| 3,604,488 | 9/1971 | Wishart | 81/451 |
| 3,739,825 | 6/1973 | Knox | 81/451 |
| 4,429,599 | 2/1984 | La Sante, Sr. | 81/441 |
| 4,716,793 | 1/1988 | Tauber | 81/53.2 |
| 5,520,075 | 5/1996 | Barmore | 81/451 |
| 5,551,320 | 9/1996 | Horobec et al. | 81/53.2 |

*Primary Examiner*—David A. Scherbel
*Assistant Examiner*—Lee Wilson
*Attorney, Agent, or Firm*—Cherskov & Flaynik

[57] ABSTRACT

A tool for removing conventional one way fasteners is provided, comprising a collar and a shank that can be removably received by the collar, wherein in the shank is configured to engage complementary regions of the fastener head. The collar includes a recess having longitudinal ridges to engage perimeter portions of the fastener head. The shank and collar cooperate to provide additional rotational force to the fastener to thereby extract the fastener, whether the fastener is flush-mounted or counter-sunk.

12 Claims, 5 Drawing Sheets

TOOL FOR INSERTING AND REMOVING ONE-WAY FASTENERS, AN OFF-CENTER TOOL FOR INSERTING AND REMOVING ONE-WAY FASTENERS

BACKGROUND OF THE INVENTION

1. Field of the Invention

The present invention relates generally to devices used for removing fasteners and, more particularly, to a device for removing one way fasteners having flat portions and convex portions located generally in diametrically opposite quadrants.

2. Background of the Invention

One way fasteners are well known. Generally, these fasteners are constructed with features that allow a threaded shank portion of the fastener, usually a threaded screw type configuration, to pass through an orifice in one structure and ultimately "screw" into an adjacently positioned second structure until a head portion of the fastener engages the first structure. Once the head portion engages the first structure, the one way fastener is very difficult to remove due to diametrically opposed flat and convex portions that are configured to provide a recess that receives a screwdriver and allows the screwdriver to forcibly insert the fastener into the second structure when the screwdriver is rotated clockwise, but prevents the screwdriver from extracting the fastener when the screwdriver is rotated in a counter-clockwise direction.

Conventional one way fasteners are nothing more than a conventional rounded head screw with diametrically opposed quadrants machined flat. This rounded head feature contributes significantly to the problem of extracting a one way fastener. One way fasteners are very effective in preventing unauthorized persons or vandals from separating the fastener-joined structures. However, occasions do arise requiring the difficult task of removing one way fasteners.

Prior art extraction devices utilize features such as jaws to grasp the sides of the head of a fastener for removal. Examples of such devices are illustrated in U.S. Pat. Nos. 5,551,320 and 5,533,426. Unfortunately, these devices are of no use when there are no accessible sides to the fastener head.

Another prior art extraction device details a tool having a pair of "tips" for engaging a pair of tip receiving recesses in the head of the one way fastener. Such a device is depicted in U.S. Pat. No. 5,450,776 issued to the applicant. The device further includes a collar with asymmetrical radial serrations to grasp the periphery of the fastener head. This tip-recess and collar-head interaction provides the "foothold" necessary to maximize the effect of any rotational force applied to the fastener removal tool. This device is limited to extracting a specially designed fastener. The device cannot function optimally when a conventional fastener such as that described above is encountered.

A need exists in the art for an inexpensive, quick set-up fastener removal tool for extracting one way fasteners having heads with flat portions and rounded or convex portions positioned in diametrically opposite quadrants. The removal tool should also facilitate extraction in situations where the fastener is counter sunk.

SUMMARY OF THE INVENTION

It is an object of the present invention to provide a device for extracting one way fasteners with rounded off heads that overcomes many of the disadvantages of the prior art.

A principal object of the present invention is to provide a device to remove either surface mount or counter-sunk one way fasteners. A feature of the device are two lugs at the end of a shank to engage corresponding convex portions of a fastener head. An advantage of the device is that by attaching a conventional rotary tool to the device, a conventional one way, rounded head fastener is easily extracted.

Another object of the present invention is to provide a collar to engage a perimeter portion of a one way fastener. A feature of the present invention is a plurality of ridges formed inside the collar to physically contact the fastener head. Another feature of the present invention is that a shank containing lugs is slidably received by the collar. An advantage of the collar is to assist the shank lugs in extracting either a surface mount or counter-sunk fastener. Another advantage of the collar is to extract a surface mount fastener without utilizing the shank lugs.

Another object of the present invention is to provide a collar capable of removing a conventional fastener having a head with an annular perimeter. A feature of the invention is an integrally joined shank-collar construction having a configuration such that longitudinal axes of the shank and collar are parallel but not aligned. An advantage of the device is that a greater amount of rotational force is focused on a smaller portion of the fastener head perimeter thereby enabling the easy extraction of a fastener having a head with a perimeter of annular configuration.

Briefly, a tool for removing a one way fastener is provided comprising a shank; an collar adapted to received said shank, a means for receiving a head portion of the one way fastener, said head-receiving means comprised of a plurality of planar walls extending substantially parallel to longitudinal axis of said collar, said walls forming a plurality of ridges that detachably engage perimeter portions of said head portion of said one-way fastener; a means for extracting said one-way fastener while at least one of said ridges physically contacts a perimeter portion of said head portion of the one-way fastener.

Also provided is a device for removing threaded fasteners with rounded off heads comprising a means for snugly receiving a head portion of said fastener; means for forming a plurality of ridges in said head portion means; a means for engaging at least one of said ridges with a perimeter portion of said head portion of said fastener and a means for forcibly rotating said fastener upon said ridge engaging said perimeter portion of said head portion thereby extracting said threaded fastener.

An extraction device for fasteners having rounded off heads is provided comprising a shank; a means for proximally positioning said shank adjacent to diametrically opposed flat upper surface portions of a fastener head; a means for axially aligning said shank and said fastener; a means for engaging said shank with diametrically opposed convex upper surface portions of said fastener head and a means for forcibly rotating said shank upon said diametrically opposed convex upper surface portions thereby forcibly extracting said threaded fastener.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
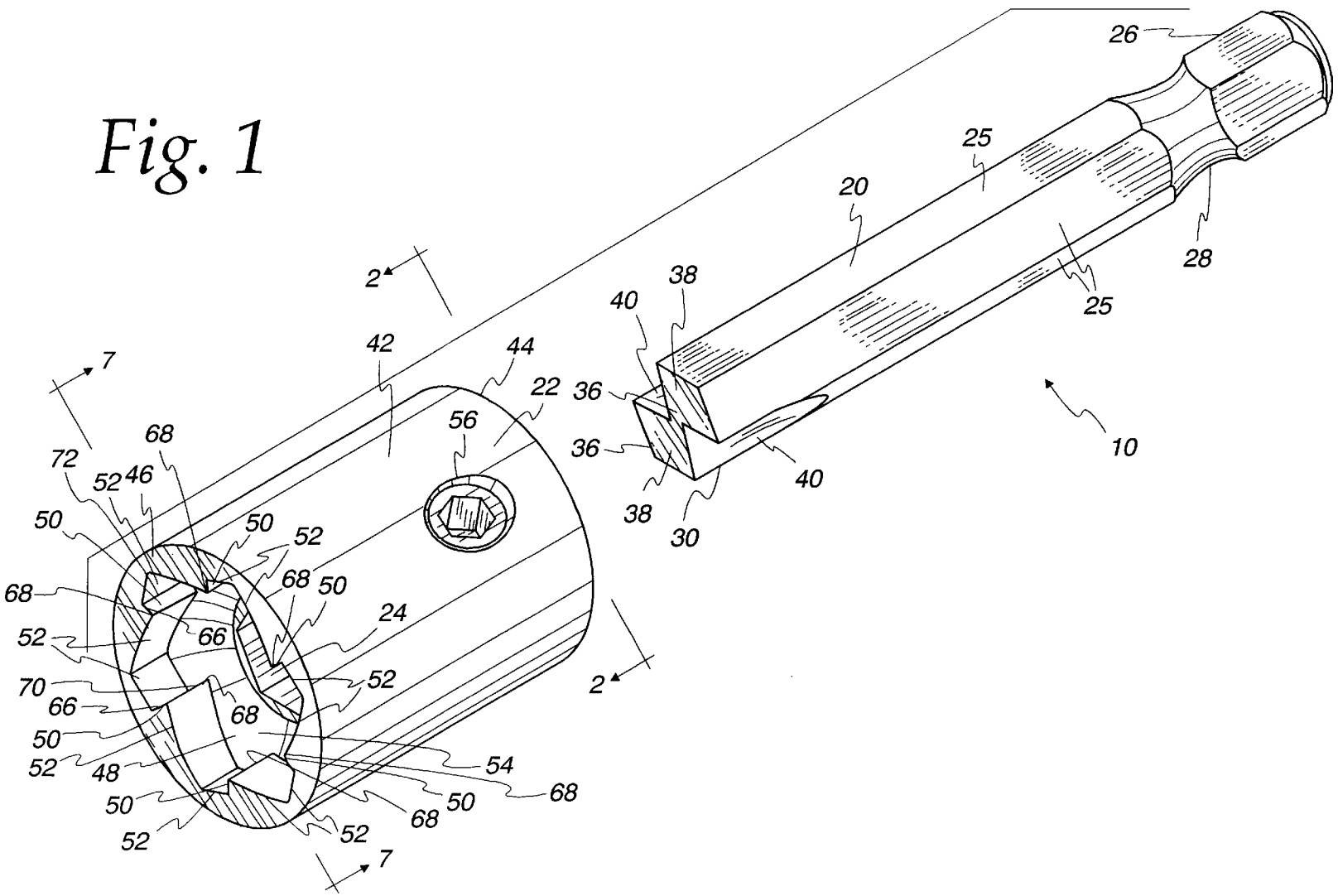
FIG. 1 is a front perspective view of a tool for removing one way fasteners in accordance with the present invention.
Figure 2:
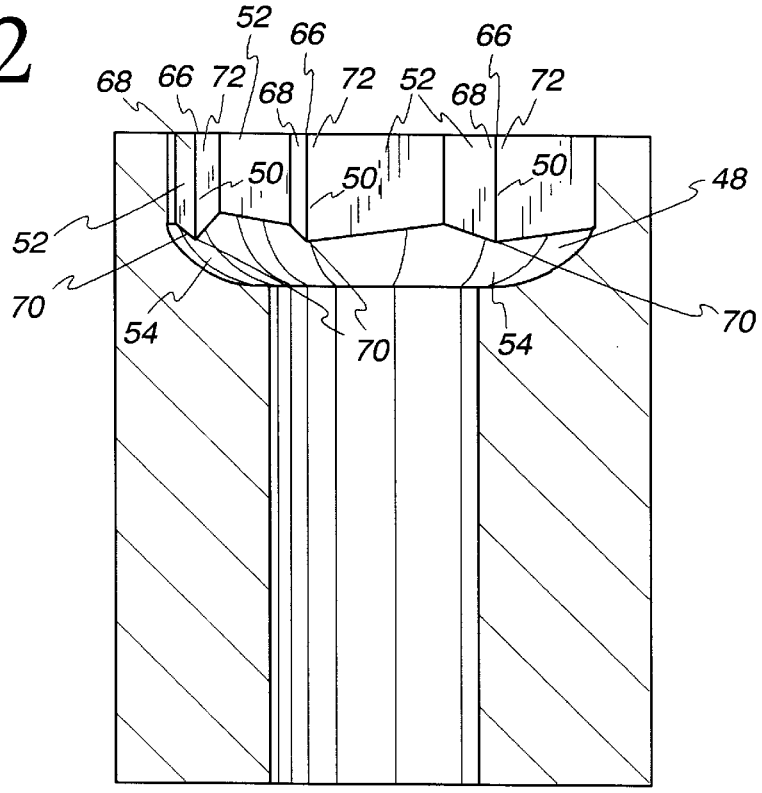
FIG. 2 is a sectional view of the collar depicted in FIG. 1 taken along line 2—2.
Figure 3:
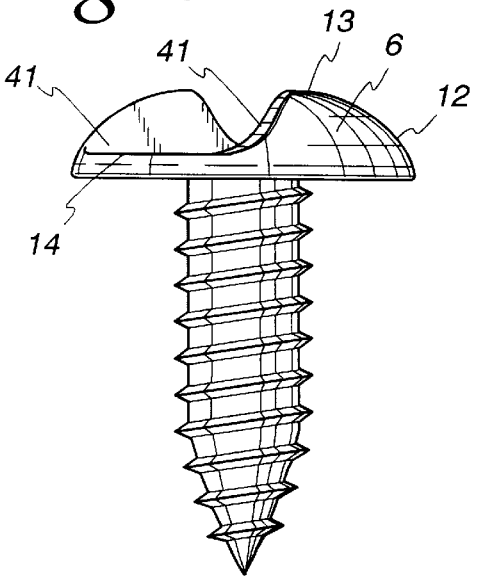
FIG. 3 is a side elevation view of a conventional fastener to be extracted with the tool depicted in FIG. 1.
Figure 4:
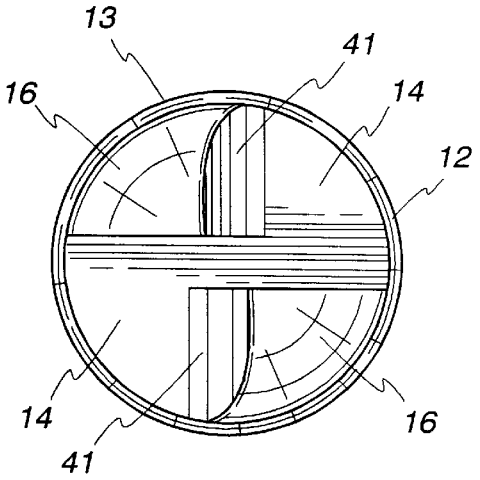
FIG. 4 is a top elevation view of the conventional fastener of FIG. 3.

In the illustrations given and more particular to FIGS. 1, 2 and 3, the reference numeral 10 designates generally a device or tool for removing a conventional type one way fastener. The fastener 12 can be a threaded screw type, having a substantially annular head 13 with flat, substantially planar diametrically opposed upper head surface portions 14, and convex diametrically opposed upper head surface portions 16.

The device 10 is fabricated from rigid material and includes a shank 20 and collar 22 that removably receives the shank 20 via a passageway 24. To facilitate manipulation with typical rotary tools, the shank 20 can be configured, when taking a view from first or grasping end 26, as a conventional type drill bit including a substantially hexagonal configuration. The hexagon configuration results from six planar walls 25 formed onto the surface of the shank 20, each wall having substantially larger longitudinal dimensions in relation to lateral dimensions. The first or grasping end 26 also includes a recess 28 circumferentially positioned to detachably receive a rotary tool. The shank 20 further includes a second or fastener engagement end 30 that is positioned upon both upper head surface portions 14 of the head 13 of the fastener 12.

The shank engagement end 30 includes two diametrically opposed and joined lugs 36, each having a substantially square or rhomboid configuration when taking an engagement end view of the shank 20. The lugs 36 have a planar lower wall 38 that is positioned adjacent to the flat portions 14 of the fastener 12. The lugs 36 result from two arcuate recesses 40 machined or otherwise molded into the engagement end 30 in opposite side walls 25 of the shank 20. The recesses 40 have a configuration that congruently contact a shank portion 41 of the convex portions 16 of the fastener head 13. Making substantial contact between the recesses 40 and the shank portions 41 of the fastener head 13, allows the shank 20 to extract the fastener 12 when sufficient rotational force is applied to the grasping end 26 of the shank 20.

Figure 5:
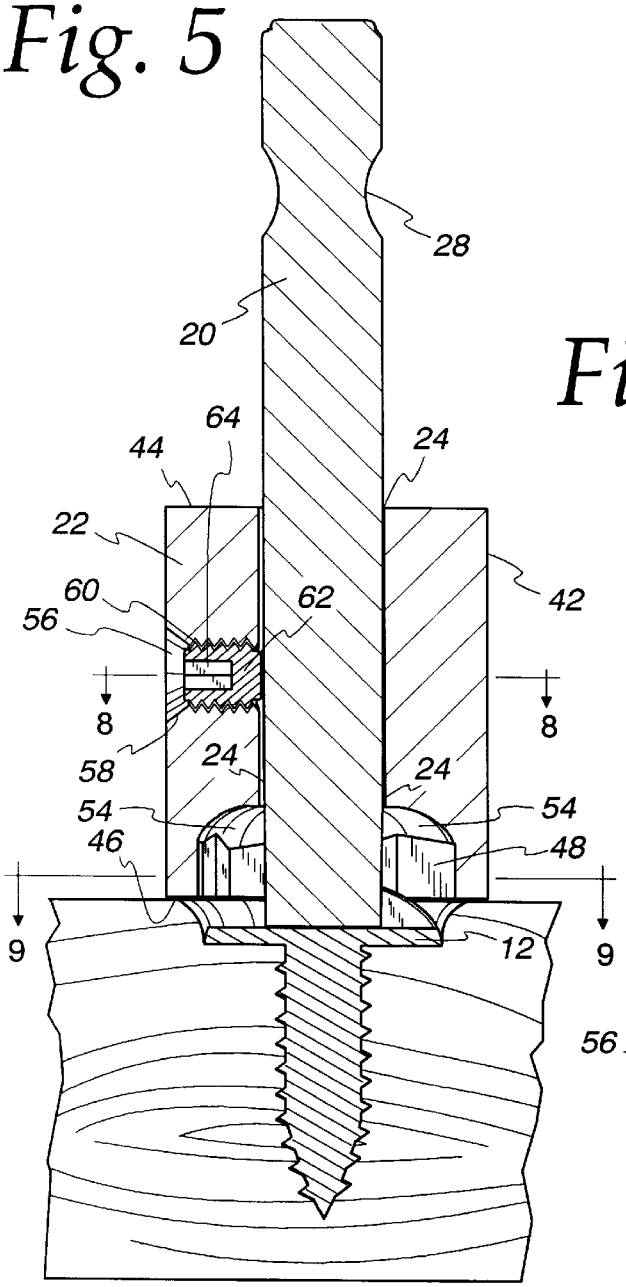
FIG. 5 is a side sectional view of a shank inserted through a collar, and engaging a conventional counter-sunk one way fastener in accordance with the present invention.
Figure 6:
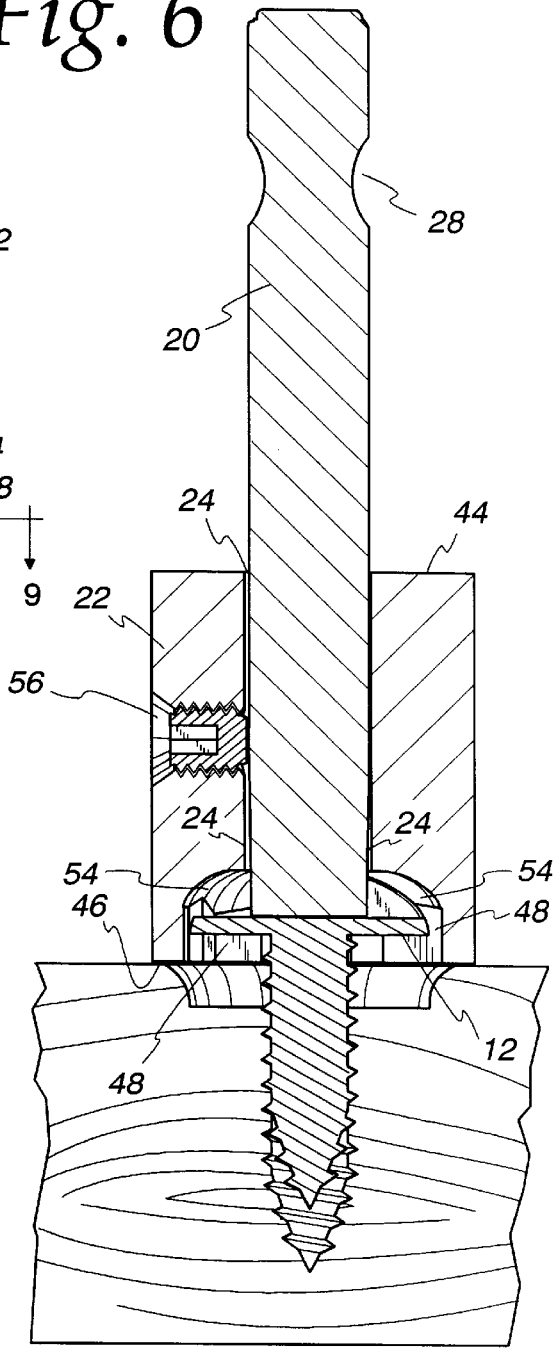
FIG. 6 is a side sectional view of the shank and collar of FIG. 2 but with the counter-sunk one way fastener partially extracted.

Although the shank 20 is capable of extracting a fastener 12 irrespective of the fastener 12 being a flush mount or counter sunk type as in FIGS. 5 and 6, the more contact the planar lower wall 38 of the lugs 36 makes with the flat portions 14 and 16 of the fastener 12, the less rotational force required to extract the fastener 12. More specifically, the shank 20 operates most efficiently when the longitudinal axis of the shank 20 is aligned with the longitudinal axis of the fastener 12. During the extraction of the fastener 12, the shank 20 has a tendency to "wobble" or move away from axial alignment with the fastener 12. This characteristic can be deleted by utilizing the collar 22 to stabilize the shank 20 when extracting flush mount or counter sunk fasteners 12.

Figure 8:
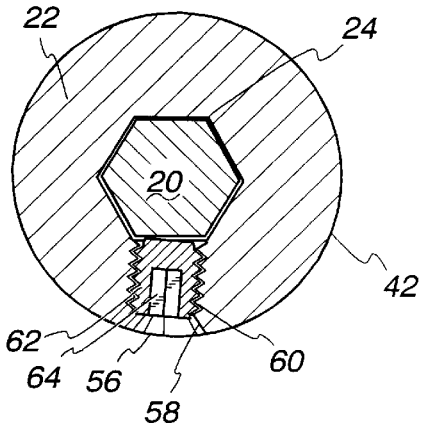
FIG. 8 is a top sectional view of the tool depicted in FIG. 5 taken along line 8—8.

Referring to FIGS. 5 and 8, the collar 22 has a cylindrical outer wall 42, an upper wall 44 that receives the shank 20 via passageway 24, and a lower wall 46 that includes a fastener recess 48 to receive the fastener 12 during extraction.

Figure 7:
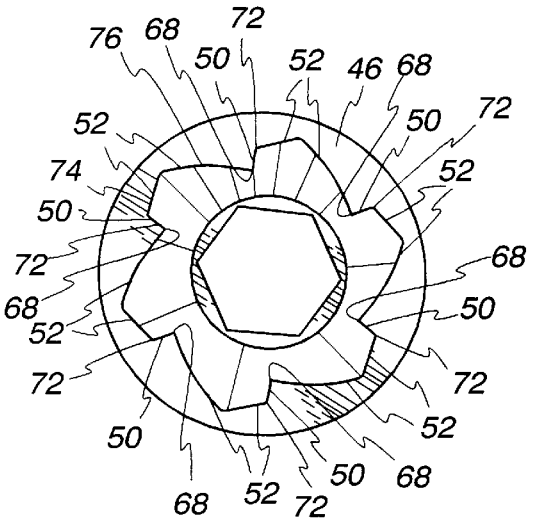
FIG. 7 is a bottom elevation view of the collar taken along line 7—7 in FIG. 1, in accordance with the present invention.

The recess 48 is configured from a plurality of planar walls 50 and an equal number of arcuate walls 52 (see FIG. 7) extending parallel to the longitudinal axis of the collar 22. Preferably, six planar walls and six arcuate walls are configured around the inner peripheral wall of the recess. The recess 48 includes a cap portion 54 that joins with the passageway 24 thereby permitting the shank 20 to insert longitudinally through the entire collar 22.

The collar 22 includes a region defining an orifice 56 having an outer frustoconically shaped portion 58 and an inner, cylindrically shaped threaded portion 60 to removably receive a setscrew 62 that is rotated via wrench recess 64. The setscrew is tightened until forcibly engaging the inserted shank 20 to maintain the longitudinal position of the collar 22 upon the surface of the shank 20. The setscrew is tightened with a conventional type allen wrench with a standard hexagonal cross-sectional configuration. The allen wrench is snugly received by the wrench recess 64 that has a hexagonal cross-sectioned configuration slightly larger in area than that of the allen wrench.

This set-screw arrangement allows the shank 20 to be juxtaposed relative to the collar 22 in a myriad of positions. For example, the shank can be adjusted so that the terminating surfaces of the lugs 36 are coextensive or coplanar with the lower wall 46 of the collar in situations where the fastener is flush mounted. Alternatively, the shank can be adjusted so as to protrude beyond the plane formed by the depending edge or lower wall 46 of the collar in situations where a countersunk fastener has to be accessed and extracted.

Figure 9:
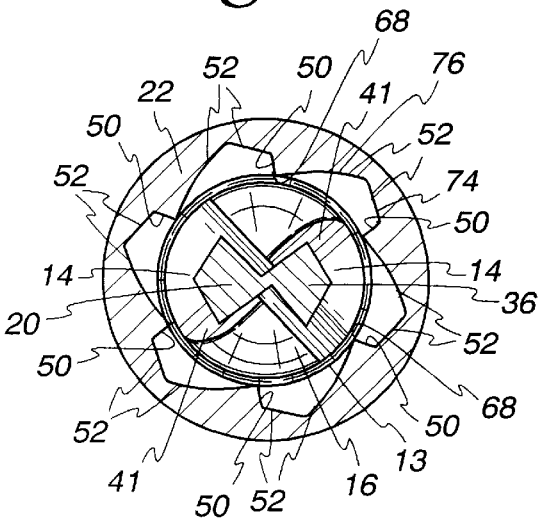
FIG. 9 is a top section view of the tool depicted in FIG. 5 taken along line 9—9.
Figure 10:
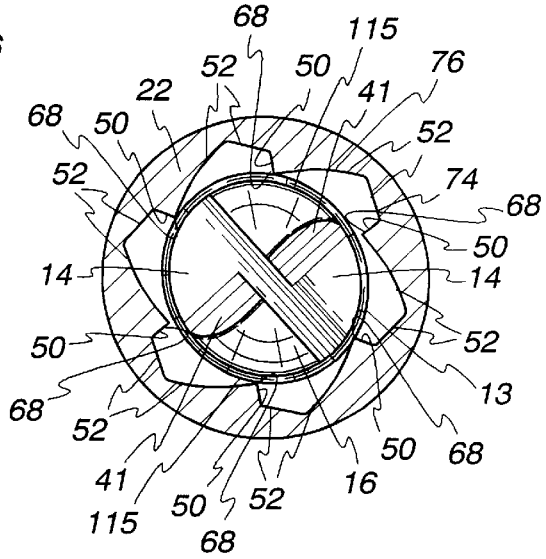
FIG. 10 is a top elevation view of the collar engaging the perimeter of a conventional one way fastener head with an oval configured head perimeter in accordance with the present invention.

Referring to FIGS. 1, 2 and 9, the planar walls 50 of the fastener recess 48 have substantially a rectangular configuration with a longitudinal dimension substantially larger than the lateral dimension. The six planar walls 50 are orientated such that a first lateral edge 66 of each wall is perpendicular to a line tangent to the perimeter of the fastener head 13. The lateral edges 66 extend a radial distance sufficient to position a first longitudinal edge 68 of each planar wall 50 in physical contact with the perimeter of the fastener head 13. The dimension of the first longitudinal edges 68 are sufficient to maintain physical contact with a perimeter portion of the fastener head 13 during the extraction of the entire fastener 12. Each longitudinal edge 68 is dimensioned to intersect with the cap portion 54 of the fastener recess 48 thereby forming a second lateral edge conforming to the relatively arcuate configuration of the cap portion 54 and forming second longitudinal edges 72 of the planar walls 50 slightly smaller in dimension than the first longitudinal edges 68.

The six arcuate walls 52 extend longitudinally from the lower wall 46 of the collar 22 to the cap portion 54 of the fastener recess 48, and laterally clockwise, when viewing the lower wall 46 of the collar 22 (see FIG. 7) from the second longitudinal edge 72 of one adjacent planar wall 50 to the first longitudinal edge 68 of a second adjacent planar wall 50. When taking an end view of the collar 22 from the lower wall 46, the arcuate walls 52 are shown configured into acute angles formed by a first relatively short leg 74 and a somewhat larger leg 76. Arcuate wall portions corresponding to the long legs 76 join with the first longitudinal edges 68 of the planar walls 50 to form sharp ridges that ultimately grasp perimeter portions of the fastener 12 as the fastener 12 is extracted from a structure. Small arcuate wall 52 portions corresponding to the short legs 74 allow for larger more gradual arcing arcuate wall 52 portions corresponding to the long legs 76.

The gradual arcing arcuate wall 52 portion allow the collar 22 to rotate while engaging a fastener head 13. The rotation is allowed in a counter-clockwise direction, when viewing the lower wall 46 of the collar 22; however, should the collar be rotated in a clockwise direction while engaging the fastener head 13, the longitudinal ridges formed by first longitudinal edge 68 of the planar walls 50 joining the arcuate walls 52 "bite" into perimeter portions of the fastener head 13 thereby extracting the fastener 12.

In operation, a shank 20 having an engagement end 30 with two diametrically opposed lugs 36 extending therefrom, is positioned adjacent to diametrically opposed flat portions 14 of a fastener head 13 of a conventional one way fastener screwed into a structure. If the fastener 12 is counter sunk into the structure as illustrated in FIG. 5, the shank 20 alone can be utilized to extract the fastener 12 to a position as detailed in FIG. 6.

Once the fastener 12 has reached the FIG. 6 position, the shank 20 can be used in combination with the collar 22 (and secured to the collar via the set screw 62) such that the fastener head 13 extends into the collar fastener recess 48. At this juncture, the lower wall 46 of the collar 22 engages the surface of a structure from which the fastener 12 is being extracted. The collar 22 is utilized to maintain the axial alignment of the longitudinal axes of the shank 20 and fastener 12, and to grip the fastener head 13 via six longitudinal ridges 68 extending parallel to the longitudinal axis of the collar 20. When rotated counter-clockwise, viewing the shank-collar combination from the first end 26 of the shank 20, the shank and secured collar enable the fastener 12 to be easily extracted until the fastener head reaches the cap portion 54 of the recess 48 whereupon the fastener 12 is completely removed.

Although the present embodiment utilizes six ridges 68 to grasp the perimeter portions of the fastener head 13, a quantity of greater or lesser numbers could be utilized to extract the fastener 12; however, using six ridges 78 configures the recess 48 to resemble that of a convention socket or wrench with a standardized hexagonal configuration.

Figure 11:
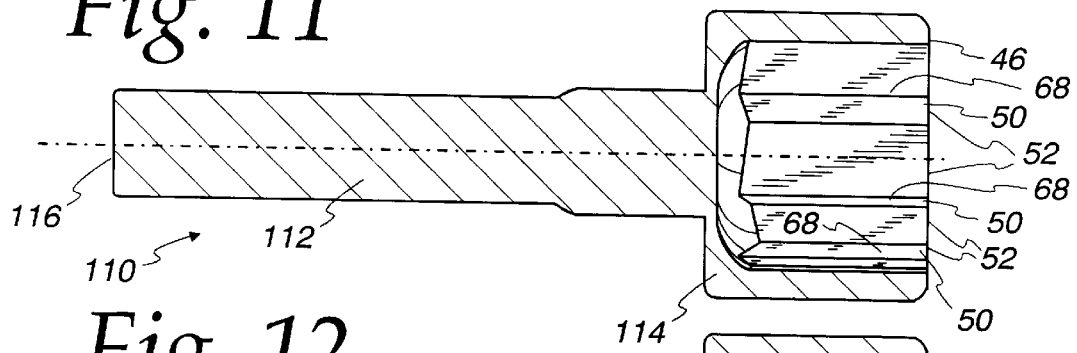
FIG. 11 is a side sectional view of an alternative embodiment of the tool depicted in FIG. 1 in accordance with the present invention.

Referring now to FIG. 11, a side sectional view of an alternative embodiment of the device 110 is depicted in accordance with the present invention. The shank 112 and collar 114 have been integrally formed into a single unit construction. The passageway 24 and set screw 62 have been deleted, but the collar's lower wall 46 and fastener recess 48 with the planar and arcuate walls 50 and 52 have the same configurations and longitudinal ridges 68 as detailed above.

The device 110 is utilized to extract fastener 12 when the fasteners are flush mounted (as compared to a countersunk fastener, see FIG. 6) upon the surface of a structure. More specifically, the entire fastener head 13 is exposed and capable of being grasped by the ridges 68. A rotary device secured to a hexagonal configured end portion 116 of the shank 112 ultimately provides the required rotational force to extract the fastener 12. The alternative device 110 is capable of extracting a fastener 12 without the aid of a shank 20 with lugs 36 as detailed above, due to the inherent configuration of a conventional one way fastener head.

Figure 12:
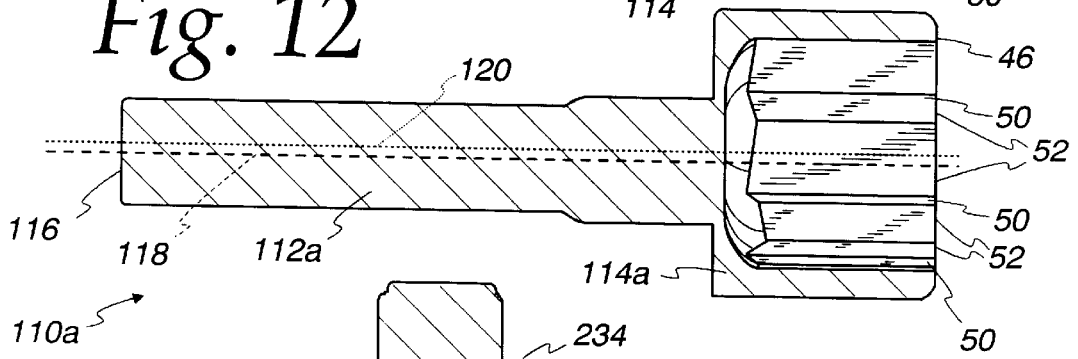
FIG. 12 is a side sectional elevation view of an alternative design of the alternative embodiment of the tool illustrated in FIG. 11 in accordance with the present invention.

An alternative design 110*a* of the integrally formed embodiment 110 is depicted in FIG. 12. The alternative design 110*a* depicts the shank 112*a* having a longitudinal axis 118 out of alignment but parallel with the longitudinal axis 120 of the collar 114*a*. Moving the shank 112*a* to an "off-center" position when joining the shank 112*a* to the collar 114*a*, results in a greater amount of force being applied to a small portion of the perimeter of the collar 114*a* and the proximally positioned ridges 68 when a rotary device drives shank 112*a*. A corresponding increased "biting" force is then exerted upon a portion of the fastener head 13 perimeter physically contacting the respective ridges 68 receiving the increased force from the collar 114*a* thereby enabling the collar 114*a* to grasp and extract the fastener 12. The "off center" shank positioning also can be utilized in those configurations where the shank is slidably received by the collar as depicted in FIG. 1.

Surprisingly by and unexpectedly, the inventors have found that the standard "tumbling" procedure for "finishing" metal goods is not to be used in fabricating the collar 22. Otherwise, sharp edges which facilitate "bite" into the fastener head would be removed, making extraction more difficult. Rather, the collar and shank components are heat-treated only.

Figure 13:
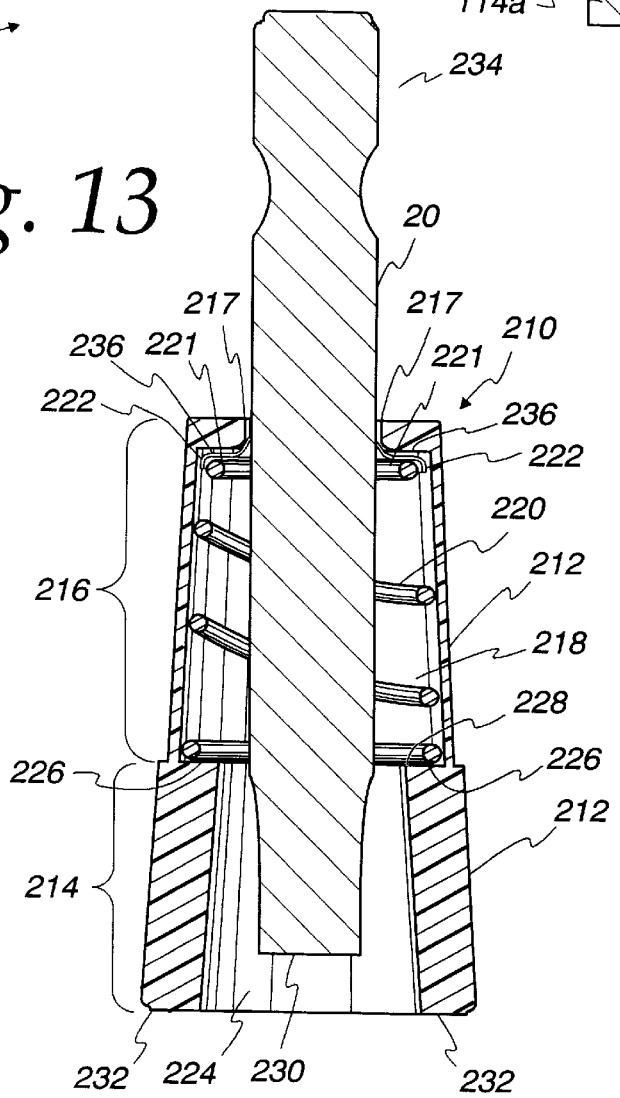
FIG. 13 is a side sectional elevation view of another alternative embodiment of the tool depicted in FIG. 1 in accordance with the present invention.

Referring to FIG. 13, a side sectional elevation view of yet another alternative embodiment of the device depicted in FIG. 1 is illustrated in accordance with the present invention. The device 210 includes the shank 20 detailed above and a modified collar 212. The collar 212 includes a lower portion 214 with smooth interior surfaces compared to the same region of the collar 22 detailed above. The collar 212 also includes an upper portion 216 integrally joined to the lower portion 214. The shank 20, upper and lower portions 216 and 214 have aligned longitudinal axes. The upper portion 216 includes a cavity 218 that receives a spring 220 having an upper end 221 engaging a retaining clip 222 secured to the shank 20 thereby securing the shank 20 to the collar 212. The cavity is substantially cylindrical with a diameter slightly larger than the lateral dimension of the recess 224 in the lower portion 214 thereby forming a lower wall 226 that a lower end 228 of the spring 220 engages. The upper portion 216 further includes a recess 217 that allows the shank 20 to insert longitudinally through the collar 212 until a lower end 230 of the shank is positioned relatively close and parallel to a lower planar wall 232 of the collar 212.

In operation, the device 210 is positioned upon a one way fastener 12 such that the recess 224 receives a surface mounted fastener head 13, the lower wall 232 of the collar 212 engages a structure to which the fastener 12 is attached, and the lower wall 230 of the shank 20 is adjacent to the fastener head 13. A rotary tool is secured to an upper end 234 of the shank 20. The rotary tool forces the shank 20 downward thereby compressing the spring 220 until the lower wall 230 of the shank 20 engages the flat portions 14 of the fastener 12. The rotary tool then rotates the shank 20 in a counter-clockwise direction until the fastener 12 is extracted whereupon the rotary tool is removed. The spring 220 then returns to a position that has the upper end 221 of the spring 220 forcibly engaging the retaining clip 222 against an internal upper wall 236 of the upper portion 216 of the collar 212 which forces the shank 20 to its original position. Thus, the shank 20 is automatically removed from the extracted fastener while the fastener 12 remains in the lower portion 214 of the collar 212.

Surprisingly and unexpectedly, the inventors found that unlike the inner surfaces of collars supra, the lower portion 214 of the collar 212 need not have a peripheral inner wall containing planar and arcuate walls to bite into the periphery of the head of the fastener, in order to provide sufficient torque to remove the fastener. Rather, the alternate embodiment having smooth inner peripheral surfaces provides sufficient fastener insertion and removal torque, particularly when the longitudinal axis of the shaft 234 is not coaxial with the longitudinal axis of the collar 212.

Although the aforementioned embodiments utilize a shank to interface the collar with a rotary device, an engagement lug, protruding from a rachet and for insertion into a recess centered in the upper wall 44 of the collar 22, could be used to establish a ratchet and socket combination for extracting conventional one way fasteners 12 as detailed above. In these instances, a fastener removal tool having its engagement lug integrally molded with its collar, would provide additional ease of use by personnel.

The foregoing description is for purposes of illustration only and is not intended to limit the scope of protection accorded this invention. The scope of protection is to be measured by the following claims, which should be interpreted as broadly as the inventive contribution permits.

The embodiment of the invention in which an exclusive property or privilege is claimed is defined as follows:

1. An extraction device for fasteners having rounded off heads comprising:

a.) a shank;

b.) a collar;

c.) means for positioning said shank adjacent to diametrically opposed flat upper surface portions of a fastener head;

d.) means for engaging said shank with diametrically opposed convex, upper surface portions of the fastener head;

e.) means for forcibly rotating said shank upon the diametrically opposed convex upper surface portions thereby forcibly extracting the threaded fastener; and f.) means for positioning a passageway in said collar such that the longitudinal axis of said passageway is not coaxial with the longitudinal axis of said collar.

2. The device of claim 1 wherein said engaging means includes a shank engagement end having diametrically opposed positioning lugs.

3. The device of claim 1 wherein said forcible rotating means includes adapting a drive end of said shank to detachably receive a rotary tool for extracting the fastener.

4. The device of claim 1 wherein said positioning means includes a shank engagement end having diametrically opposed positioning lugs.

5. The device of claim 1 wherein said positioning lugs are substantially square in configuration when taking an engagement end view of said shank.

6. A tool for removing a one way fastener comprising:

a.) a shank adapted to receive a drive tool thereupon;

b.) a collar adapted to removably receive said shank such that a fastener engagement end of said shank is positioned to congruently engage corresponding shank portions of the fastener head, said collar comprised of a plurality of fastener extraction members that engage a perimeter portion of the fastener head, said collar having a longitudinal axis that is not coaxial with the longitudinal axis of said shank; and c.) means for cooperatively rotating said shank and said collar while said shank and said collar engage respective portions of the one way fastener thereby extracting the fastener from a structure.

7. A tool for removing a one way fastener comprising:

a.) a shank adapted to receive a drive tool thereupon;

b.) a collar adapted to removably receive said shank such that a fastener engagement end of said shank is positioned to congruently engage corresponding shank portions of the fastener head, said collar comprised of a plurality of fastener extraction members that engage a perimeter portion of the fastener head, said collar having a passageway therethrough to removably receive said shank, said passageway having a longitudinal axis axially aligned with the longitudinal axis of the fastener, said longitudinal axis of said passageway is not coaxial with the longitudinal axis of said collar; and c.) means for cooperatively rotating said shank and said collar while said shank and said collar engage respective portions of the one way fastener thereby extracting the fastener from a structure.

8. A one way fastener extraction tool comprising:

a shank;

a collar adapted to removably receive said shank such that a fastener engagement end of said shank is positioned in cooperative rotational engagement with a head portion of the fastener, said collar comprised of a lower portion that receives an upper fastener portion, and an upper portion having a cavity that receives a spring, said collar having a longitudinal axis that is not coaxial with the central longitudinal axis of said shank;

means for compressing said spring when said fastener engagement end of said shank is moved from a first position to a second position whereby said fastener engagement end of said shank is placed in cooperative rotational engagement with the head portion of the fastener; and means for returning said shank to said first position.

9. The tool of claim 8 wherein said compressing means includes a retainer clip engaging an upper end of said spring with said clip being secured to said shank, and a lower end of said spring engaging a lower wall of said collar cavity.

10. The tool of claim 8 wherein said returning means includes an upper wall of said collar cavity engaging said retainer clip, said retainer clip being urged into forcible engagement with said upper wall of said collar cavity by said spring upon the removal of a rotary tool from said shank.

11. The tool of claim 8 wherein said collar includes a plurality of planar walls extending substantially parallel to the longitudinal axis of said collar, said walls forming a plurality of ridges that detachably engage perimeter portions of the head portion of the fastener.

12. The tool of claim 11 wherein said ridges extend substantially parallel to the longitudinal axis of said collar, said ridges formed from a first planar wall joining a second arcuate wall.

* * * * *